US005624178A

United States Patent [19]

Lee, Jr.

[11] Patent Number: 5,624,178

[45] Date of Patent: Apr. 29, 1997

[54] UNIVERSAL DECORATIVE FACADE TELESCOPING FIXTURE

[76] Inventor: Robert T. Lee, Jr., 313 West Shore, So. Hero, Vt. 05486

[21] Appl. No.: 538,384

[22] Filed: Oct. 3, 1995

[51] Int. Cl.[6] ..... F21S 3/00; F21V 19/02

[52] U.S. Cl. ..... 362/220; 362/366; 362/372; 362/418

[58] Field of Search ..... 362/294, 372, 362/373, 366, 362, 418, 285, 147, 220, 430, 217

[56] References Cited

U.S. PATENT DOCUMENTS

| | | | |
|---|---|---|---|
| 3,541,321 | 11/1970 | Spiteri | 362/418 |
| 3,673,402 | 6/1972 | Weiss | 362/220 |
| 4,455,594 | 6/1984 | Yang | 362/362 |
| 4,887,196 | 12/1989 | Brown et al. | 362/373 |
| 4,930,054 | 5/1990 | Krebs | 362/373 |
| 5,154,507 | 10/1992 | Collins | 362/220 |
| 5,226,724 | 7/1993 | Kanarek | 362/260 |
| 5,272,608 | 12/1993 | Engle | 362/217 |

*Primary Examiner*—Ira S. Lazarus
*Assistant Examiner*—Sara Sachie Raab

[57] ABSTRACT

A light fixture has universal application in soffit downlighting situations. The light fixture consists of a sturdy metal housing capable of telescoping in or out to fit flush on either end with any two parallel walls. The invention has appropriate configuration to hold a multitude of different types of lampholders. The light fixture has wall and ceiling mounting capabilities. The invention has an exterior facade capable of mounting, by adhesive or mechanical means, any appropriate finish with the intent to match room decor.

17 Claims, 3 Drawing Sheets

UNIVERSAL DECORATIVE FACADE TELESCOPING FIXTURE

FIELD OF INVENTION

This invention relates to all residential, commercial and kitchen and bathrooms where lighting is required over sink basins and vanity mirrors. Other appropriate locations include any lighting situation requiring wall mounted or ceiling mounted downlighting.

BACKGROUND ART

Light fixtures presently available on the marketplace do not offer any way to inconspicuously blend into a room's decor. This lighting consists of bulb strips, fluorescents with plastic covers, or swages on either side of the medicine cabinets. Most lights are presented as a particular design manufactured by a particular lighting company. Modification options to the design by the buyer are not possible.

For most builders and remodelers the consequence of this has always been to provide a "custom built in" soffit light. This is normally achieved by building a light box from scratch using conventional lumber—a time consuming and labor intensive practice.

SUMMARY AND OBJECTS

This invention is an appropriate substitute to the limited fixtures available in the marketplace as well as a time saving alternative to constructing a "custom built in" light box. When decorated, this light fixture appears like a "custom built in" fixture. While there are extensive light fixture patents in the United States, there appear to be no direct conflicting patents with the claimed features of this Telescoping Downlight Fixture.

This light fixture is designed for quick, easy, economical and aesthetic purposes. It is the intent of this fixture to fit into a broad range of downlighting applications by telescoping to length, centering the light, then having a decorative finish applied to the facade.

In many applications this light fixture may telescope to fit between two parallel walls, but some applications may not have two parallel walls for the light to butt up against when extended. In these situations where one or both of the sides of the fixture may be visible, these side surfaces may be decorated in the same manner as the front face.

The invention may come in a number of sizes. Each size may telescope to fit a range of distances from the smallest required distance to the fully telescoped longest distance. For example, one size might telescope between 24"–36", another one between 36"–48", and another one between 48"–60". Distances longer than 60" would be covered by stacking two or more of the previously mentioned units lengthwise. In this way all ranges of required length are covered.

This invention preferably has a flat, smooth mounting surface located at the front and sides of a lampholding Slide. These surfaces allow univeral mounting of substantially any decorative material by either mechanical means (drilling and screwing) or by adhesive fastening. The common decorative materials include, but are not limited to, hardwood, softwood, tile, marble, stone, paint, wallpaper and plastic laminate. The light is preferably projected out the bottom from behind the decorative fascade.

This light fixture is capable of utilizing many types of lighting by configuring the Slide to hold the necessary lampholders. These may include but, are not limited to, ballast, electronic ballast, fluorescent compacts, most sizes and types of fluorescent light tubes, incandescent light bulbs, halogen, mercury vapor, sodium, etc. This universality may be achieved by reconfiguring the Slide to accept alternative lampholders.

A lens or grille such as eggcrates, parabolics, diffusers, glass, plastic, is cut to size after installation and may be constructed of any material capable of diffusing light. This lens or grill may be easily inserted or removed for light bulb changes and cleaning by pushing up, twisting, then pulling down and out.

The light fixture may be equipped with punched slots or holes on its top surface for heat dissipation allowing a constant flow of air to rise up through the lens, past the bulbs, and out the top of the light.

DESCRIPTION OF THE PREFERRED EMBODIMENTS

Figure 1:
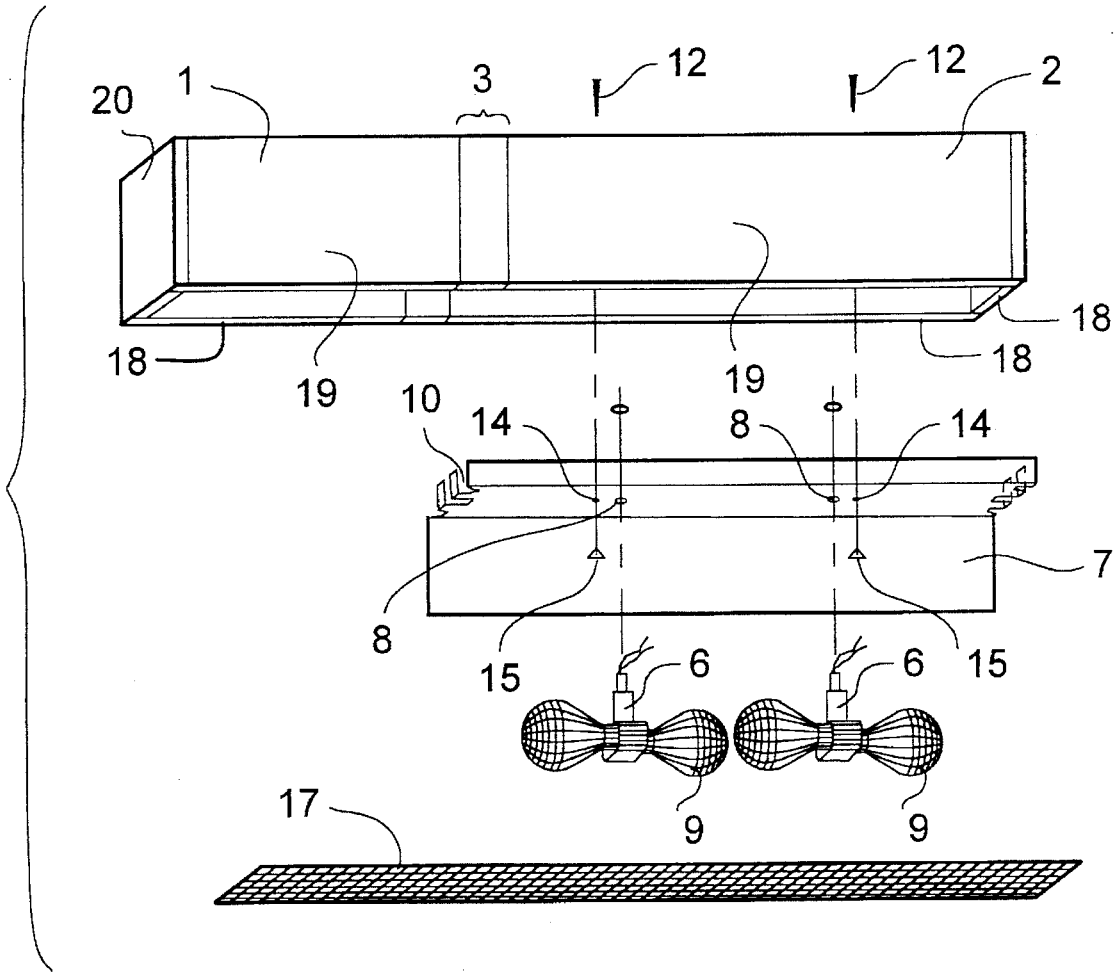
FIG. 1 is an exploded view showing the parts of a disassembled unit.
Figure 3:
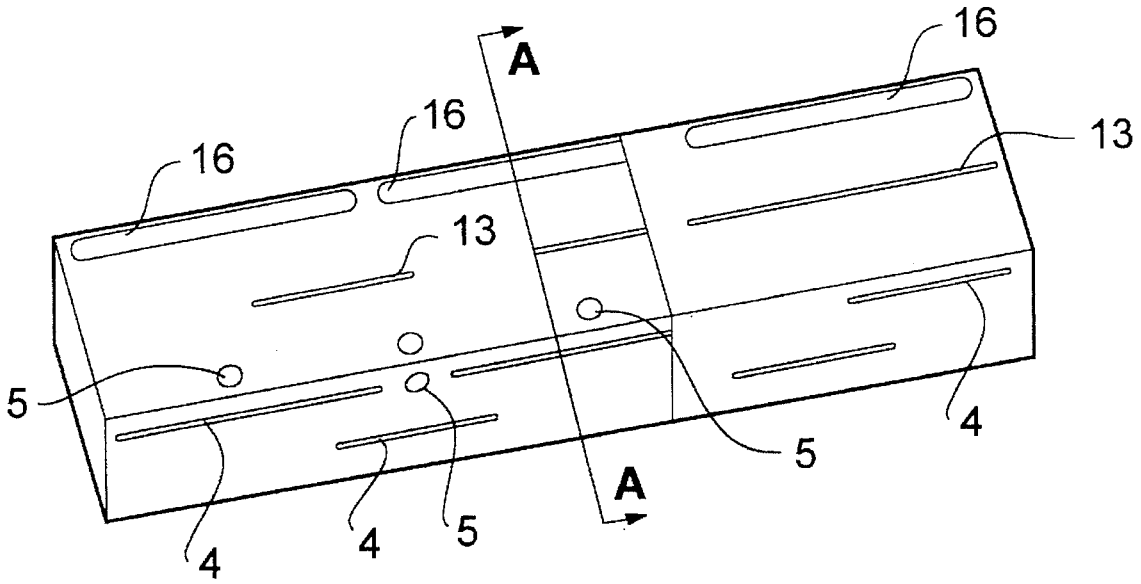
FIG. 3 is a top and Back view showing slots and holes.

Referring to the exploded view in FIG. 1, an outer frame includes an Extender 1 that slides over or within a Mainbox 2, causing an overlap 3. This provides the telescoping effect so the unit extends or contracts to fit between any two parallel walls; or otherwise, just extends to a suitable length. The telescoped unit is fastened to a wall with screws inserted from inside the light fixture through slots 4. See FIG. 3. The power wire is fed through the box 2 at any suitable punched hole 5. Any wire connector required by electrical codes such as a Romex connector can be utilized in any of holes 5 to properly hold the power wire. Standard electrical wiring is then performed on the lampholders 6 which are threaded into a fixture retaining Slide 7 through punched holes 8.

Figure 2:
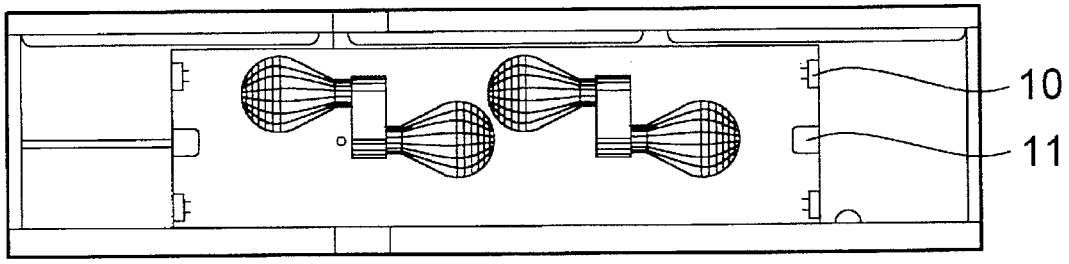
FIG. 2 bottom view without lens in place

The illustrated embodiments include incandescent lampholders 6 and incandescent bulbs 9, but can be configured to use any type of lampholder just by punching other configurations such as punched holes 10 and 11 which would be used for fluorescent lighting See. FIG. 2. The punches located in the Slide 7 depict typical configurations needed to hold incandescent lighting.

Figure 4:
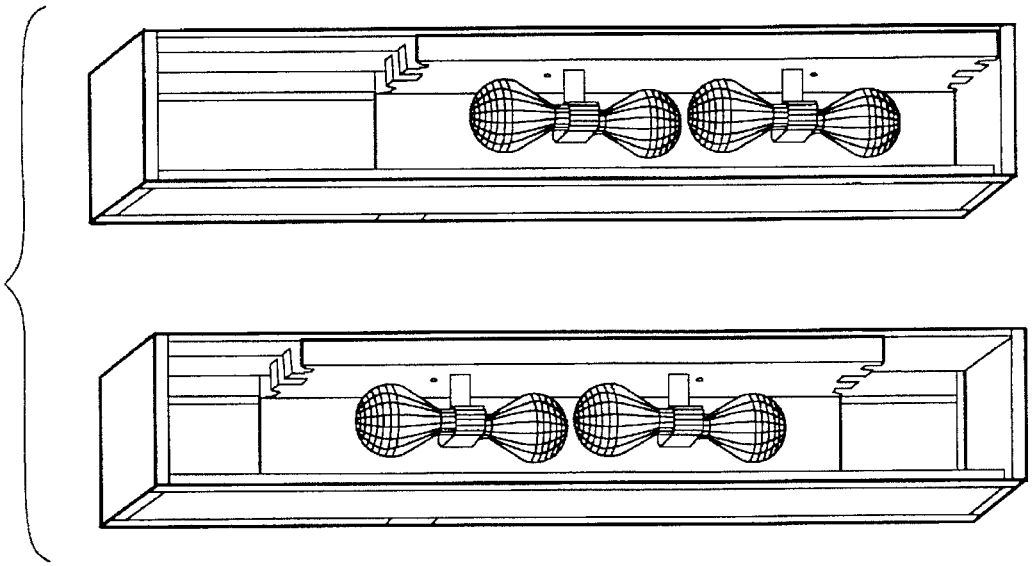
FIG. 4 shows movement of the Slide; top view as initially installed and bottom view showing Slide centered.
Figure 5:
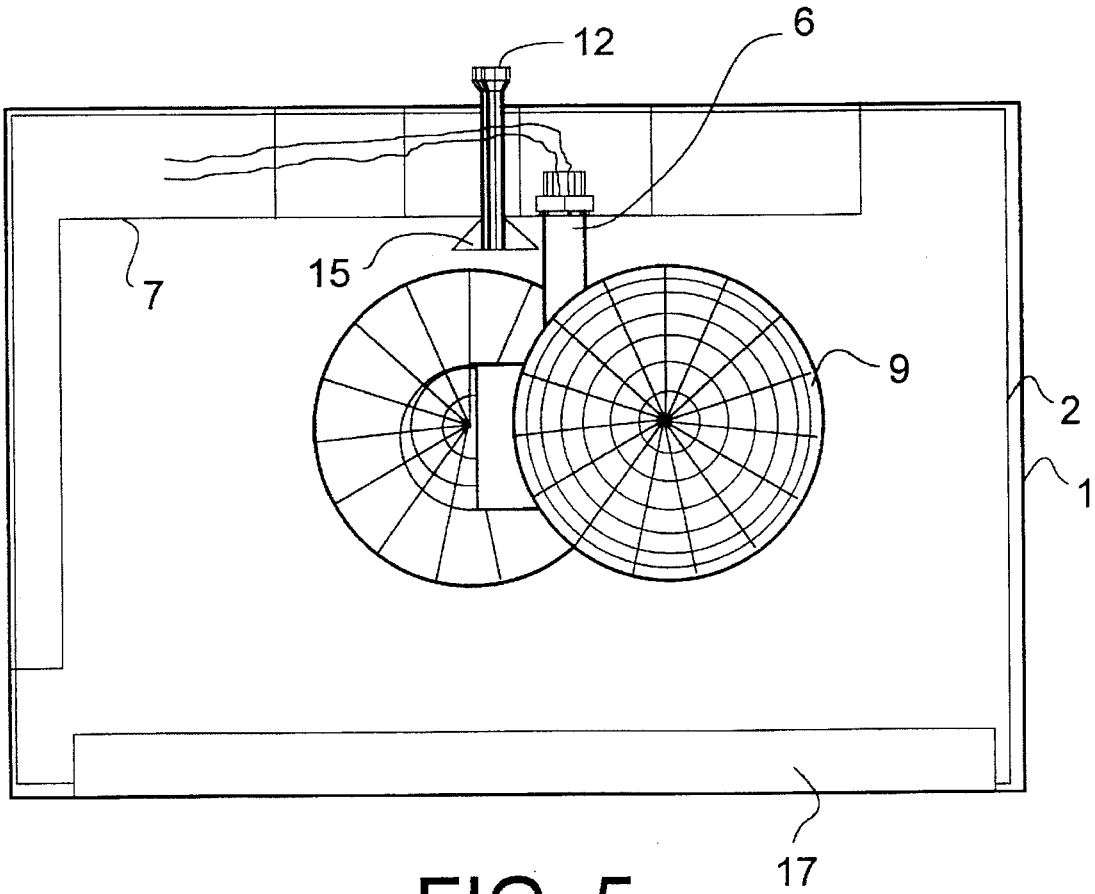
FIG. 5 depicts a Cross section through the middle of the light.

The Slide 7 fits into the telescoped Mainbox 2 and Extender 1. The Slide 7 is held in place inside the Mainbox 2 with carriage bolts 12 dropped from the top through slots 13 and continuing through the Slide 7 at holes 14. See FIGS. 3 and 5. Fastening nuts 15 are applied to the protruding carriage bolts 12 allowing the Slide 7 to travel an amount equal to the length of the slots 13. This movement is shown by FIG. 4. This travel allows the light to be centered or otherwise moved to provide more intense lighting over the intended target area. This travel capability is otherwise known as the invention's "centering capablility".

Light bulbs 9 are screwed into lampholders 6. Heat from the bulbs is dissipated through top Slots 16.

A lens or grill 17 is set up inside the unit and maybe held in place by a Flange 18 of the Mainbox 2 and Extender 1.

The Front surface 19 and Side surfaces 20 of the Mainbox 2 and Extender 1 may be decorated with virtually any commonly available decoration.

I claim:

1. A lighting fixture, comprising:

an outer frame that includes a mainbox and an extender that is slidably engaged to said mainbox, whereby the outer frame may be adjusted to any desired length by adjusting a relative position of the mainbox and the extender;

a fixture retaining slide mounted within said outer frame;

a light fixture mounted to said fixture retaining slide; and means for adjusting a position of the fixture retaining slide within the outer frame to a desired position, wherein the adjusting means includes elongated slots formed in a surface of the outer frame and fasteners for fastening the fixture retaining slide to the mainbox through the elongated slots.

2. The lighting fixture of claim 1, wherein the extender fits telescopically within the mainbox.

3. The lighting fixture of claim 2, wherein the adjusting means includes elongated slots formed in a surface of the outer frame and fasteners for fastening the fixture retaining slide to the mainbox through the elongated slots.

4. The lighting fixture of claim 2, wherein the fixture retaining slide includes means that may be configured to receive one of an incandescent fixture and a fluorescent fixture.

5. The lighting fixture of claim 1, wherein the mainbox and the extender form a continuous flat front facade for receiving decorative panels.

6. The lighting fixture of claim 5, wherein the outer frame includes flat side facades for receiving decorative panels.

7. The lighting fixture of claim 1, further comprising ventilation holes in an upper surface of the outer frame.

8. The lighting fixture of claim 1, wherein the fixture retaining slide includes means that may be configured to receive one of an incandescent fixture and a fluorescent fixture.

9. The lighting fixture of claim 1, wherein the fixture retaining slide includes means that may be configured to receive one of an incandescent fixture and a fluorescent fixture.

10. The lighting fixture of claim 9, further comprising elongated slots on a back side of the outer frame for accommodating mounting fasteners.

11. The lighting fixture of claim 1, further comprising elongated slots on a back side of the outer frame for accommodating mounting fasteners.

12. The lighting fixture of claim 1, further comprising elongated slots on a back side of the outer frame for accommodating mounting fasteners.

13. A lighting fixture, comprising:

a mainbox having a width extending in a longitudinal direction;

an elongated slot in an upper surface of said mainbox, said slot extending in the longitudinal direction of the mainbox; and a fixture retaining slide that is adjustably mounted within said mainbox with a fastener extending through said elongated slot, wherein a position of the fixture retaining slide may be changed by moving the fastener within the elongated slot.

14. The lighting fixture of claim 13, wherein the width of the mainbox is adjustable.

15. A method of mounting a light fixture that includes an outer frame that is adjustable in width and a fixture retaining slide that may be adjustably mounted within the outer frame, comprising the steps of:

adjusting the width of the outer frame to a desired size by sliding a first part of the outer frame within a second part of the outer frame;

securing the outer frame at an intended location;

adjusting a position of the fixture retaining slide within the outer frame to a desired location; and securing the slide in the outer frame at the desired location extending fasteners from the fixture retaining slide through elongated slots in a surface of the outer frame.

16. The lighting fixture of claim 15, wherein the width adjusting step includes telescopically sliding the second part within the first part.

17. The lighting fixture of claim 16, wherein the slide securing step includes extending fasteners from the fixture retaining slide through elongated slots in a top surface of the outer frame.

* * * * *